US006184186B1

(12) United States Patent
Ryan et al.

(10) Patent No.: US 6,184,186 B1
(45) Date of Patent: Feb. 6, 2001

(54) LUBRICATING COMPOSITIONS

(75) Inventors: Helen T. Ryan, London; Rodney I. Barber, Bracknell; Craig R. Paterson, Newbury, all of (GB)

(73) Assignee: Ethyl Petroleum Additives, Ltd, Bracknell (GB)

( * ) Notice: Under 35 U.S.C. 154(b), the term of this patent shall be extended for 0 days.

(21) Appl. No.: 09/288,723

(22) Filed: Apr. 9, 1999

(51) Int. Cl.[7] ..... C10M 141/12
(52) U.S. Cl. ..... 508/322; 508/459; 508/537
(58) Field of Search ..... 508/287, 322

(56) References Cited

U.S. PATENT DOCUMENTS 4,158,633 * 6/1979 Papay ..... 252/32.7 E
4,280,916 * 7/1981 Richards et al. ..... 252/33.4
5,176,840 * 1/1993 Campbell et al. ..... 252/49.6
5,225,093 * 7/1993 Campbell et al. ..... 252/51.5 A
5,650,381 * 7/1997 Gatto et al. ..... 508/364
5,942,470 * 8/1999 Norman et al. ..... 508/189

FOREIGN PATENT DOCUMENTS

389237 * 9/1990 (EP) .
WO 88-04313 * 6/1988 (WO) .

* cited by examiner

*Primary Examiner*—Ellen M. McAvoy
(74) *Attorney, Agent, or Firm*—Dennis H. Rainear; Thomas Hamilton; James T. Moore

(57) ABSTRACT

Use of at least one friction modifier to reduce micropitting of a metal surface, which comprises lubricating the metal surface with a lubricant composition comprising the at least one friction modifier, wherein the at least one friction modifier is selected such that micropitting is reduced when the metal surface is so lubricated.

1 Claim, No Drawings

LUBRICATING COMPOSITIONS

The present invention relates to the use of friction modifiers to reduce micropitting of metal surfaces such as gear teeth, and to lubricant compositions comprising friction modifiers.

Micropitting is a type of surface damage which occurs predominantly in rolling-sliding contacts of hard steel surfaces. Sometimes called "frosting", "greystaining" or "peeling" it typically occurs in rolling element bearings and most often on gear teeth, where it poses a significant practical problem. Micropitting may lead to higher noise, to significant rapid wear and to more serious surface damage, such as scuffing and even to tooth fracture in gears. Conventional lubricants are used to reduce friction when metal surfaces move in contact with each other but they do not prevent the occurrence of micropitting. Original equipment manufacturers require lubricants which can lead to a reduction in the amount of micropitting when compared with the conventional lubricants. It is an object of the present invention to meet this need.

The awareness of micropitting within the lubricant additives industry has increased significantly. A micropitting test has been established by the FZG Institute in Germany and is called the FZG micropitting test. This test is run on gears sets with the same metallurgy and surface profile/roughness as gears used in the field. The conditions of the test (high load/low speed) are the optimum conditions for micropitting to occur. Equipment manufacturers believe that the FZG micropitting test correlates well with field experience.

The FZG micropitting test is carried out using a standardized FZG test rig according to CEC L-07-A-71, with C type case hardened gears of minimum 0.4 Ra surface roughness. The test has a stepwise phase to investigate build up of micropitting and an endurance phase to investigate resistance to micropitting. The stepwise phase runs from load stage 5 to load stage 10, each stage lasting 16 hours. The profile of the gears is measured prior to testing and during the test. The variation from the original gear profile (the profile deviation) is calculated. Also evaluated are the percentage micropitting (the percentage of gear tooth which is micropitted) and the weight loss from the gears. After the stepwise phase the endurance phase is run for 80 hours at load stage 8 and then at load stage 10 until failure. Again, the deviation from the original profile (maximum 20 microns), the level of micropitting and the weight loss are measured. A result which would be particularly acceptable to the industry would be a pass at load stage 10 in the stepwise phase of the test. This corresponds to a profile deviation of less than 7.5 $\mu$m, micropitting of less than 15% (approx) and weight loss of less than 15 mg (approx) after load stage 10. Extended performance in the endurance phase is also desirable.

The present invention is based on the surprising appreciation that certain friction modifiers may be included in lubricant compositions with the result that an improvement in micropitting performance is observed when the lubricant compositions are used, i.e. there is reduced micropitting. Accordingly, the present invention concerns the use of at least one friction modifier to reduce micropitting of a metal surface, which comprises lubricating the metal surface with a lubricant composition comprising the at least one friction modifier, wherein the at least one friction modifier is selected such that micropitting is reduced when the metal surface is so lubricated.

The metal surface may be the surface of a gear tooth, in which case the at least one friction modifier may be added to a formulated gear lubricant composition.

In the present specification the term "friction modifier" is used to describe additive compounds which are conventionally used in lubricant compositions to reduce friction. The friction modifiers which are useful in practising the present invention are all known in the art.

In accordance with the present invention it has been found that only certain friction modifiers may be used to give the desired technical effect of reduced micropitting. The efficacy of any given friction modifier in reducing micropitting may be assessed by comparing the amount of micropitting observed when a metal surface is lubricated with a lubricant composition comprising the friction modifier with the amount of micropitting observed when an identical metal surface is lubricated (under the same conditions) using the corresponding lubricant composition from which the friction modifier of interest has been omitted. The FZG micropitting test may be used to assess the relative performance of lubricant compositions.

Another way of identifying suitable friction modifiers is by reference to the friction coefficient of lubricants including them. It has been found that the at least one friction modifier may be selected such that, when measured at 130° C. using a high frequency reciprocating rig (HFRR) under the conditions described in SAE Technical Paper 961142, a lubricant which comprises the friction modifier and which has a viscosity grade of ISO 220 has a coefficient of friction of 0.100 or less. The HFRR test may thus be employed as a screen for useful friction modifiers. Lubricant compositions which have a viscosity grade of ISO 220 and which are useful in screening friction modifiers may be prepared by blending a conventional sulphur- and phosphorus-containing gear additive package with a base oil having a viscosity of between $1.98\times10^{-4}$ to $2.42\times10^{-4}$ $m^2/s$ (198 to 242 cSt) at 40° C. Suitable additive packages include those comprising from 15–75 wt %, preferably from 45–65 wt %, of a sulfurized isobutylene, from 0–25 wt %, preferably from 3–15 wt %, of a phosphorus-containing antiwear agent, from 0–60 wt %, preferably from 5–25 wt % of a carboxylic-type or Mannich-type ashless dispersant from 0–20 wt %, preferably from 1–10 wt % of corrosion and rust inhibitors, from 0–20 wt %, preferably from 1–10 wt %, of surface active agents and diluent oil. Such additive packages are commercially available. The additive package is used at conventional treat rates. A suitable base oil to use in formulating the compositions includes a blend of 51 wt % ESSO 600SN and 49 wt % of 2500 Brightstock. Useful additive package are described in EP-A-0744456 and EP-A-0812901.

A number of different classes of friction modifiers have found to be useful in the present invention. Mention may be made of phosphonate esters, phosphite esters, aliphatic succinimides, molybdenum compounds and acid amides.

Useful phosphonate esters include O,O-di-(primary alkyl)acyclic hydrocarbyl phosphonates in which the primary alkyl groups are the same or different each independently containing 1 to 4 carbon atoms and in which the acyclic hydrocarbyl group bonded to the phosphorus atom contains 12 to 24 carbon atoms and is a linear hydrocarbyl group free of acetylenic unsaturation. These compounds thus comprise O,O-dimethyl hydrocarbyl phosphonates, O,O-diethyl hydrocarbyl phosphonates, O,O-dipropyl hydrocarbyl phosphonates, O,O-dibutyl hydrocarbyl phosphonates, O,O-diiso-butyl hydrocarbyl phosphonates, and analogous compounds in which the two alkyl groups differ, such as, for example, O-ethyl-O-methyl hydrocarbyl phosphonates, O-butyl-O-propyl hydrocarbyl phosphonates, and O-butyl-O-isobutyl hydrocarbyl phosphonates, wherein in each case the hydrocarbyl group is linear and is saturated or contains one or more olefinic double bonds, each double bond preferably being an internal double bond. Preferred are compounds in which both O,O-alkyl groups are identical to each other. Also preferred are compounds in which the hydrocarbyl group bonded to the phosphorus atom contains 16 to 20 carbon atoms. A preferred friction modifier in this class is dimethyloctadecyl phosphonate. Phosphonate esters useful in the present invention are described in U.S. Pat. No. 4,158,633.

Useful phosphite esters are described in WO88/04313. These include dihydrocarbyl hydrogen phosphites in which the hydrocarbyl groups are the same or different linear aliphatic hydrocarbyl groups free of acetylenic unsaturation each independently containing 8 to 24 carbon atoms, and amine salts of these phosphites. The phosphites typically contain linear aliphatic hydrocarbyl groups, each of which contains 12 to 24, preferably 16 to 20 carbon atoms. It is also preferred that at least 50% of the hydrocarbyl groups in the dihydrocarbyl hydrogen phosphite contain at least one internal double bond. It is preferred to use dioleylphosphite.

Preferred amine salts of the foregoing dihydrocarbyl hydrogen phosphites are those in which the aliphatic group of the amine is a linear primary aliphatic group having 8 to 24 carbon atoms, for example 16 to 20 carbon atoms, and in which at least 50% of the aliphatic groups contain one or more internal double bonds.

Useful succinimides include those of formula:

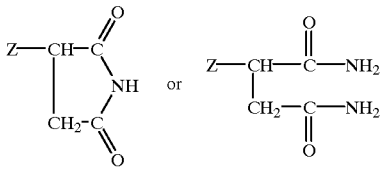

in which Z is a group $R^1R^2CH$— in which $R^1$ and $R^2$ are the same or different each independently representing straight- or branched-chain hydrocarbon groups containing from 1 to 34 carbon atoms and the total number of carbon atoms in the groups $R^1$ and $R^2$ is from 11 to 35. Such compounds are described in EP-A-0020037, EP-A-0389237 and EP-A-0776964.

The radical Z may be, for example, 1-methylpentadecyl, 1-propyltridecenyl, 1-pentyltridecenyl, 1-tridecylpentadecenyl or 1-tetradecyleicosenyl. Preferably the number of carbon atoms in the groups $R^1$ and $R^2$ is from 16 to 28 and more commonly 18 to 24. It is especially preferred that the total number of carbon atoms in $R^1$ and $R^2$ is about 20 or about 22. Preferably, the succinimide is a 3-$C_{18-24}$ alkenyl-2,5-pyrrolidindione. A sample of this succinimide contains a mixture of alkenyl groups having from 18 to 24 carbon atoms.

Useful molybdenum compounds are described in U.S. Pat. No. 5,650,381. These compounds are typically substantially free of active sulphur. Examples of suitable compounds include glycol molybdate complexes as described in U.S. Pat. No. 3,285,942, overbased alkali metal and alkaline earth metal sulfonates, phenates and salicylate compositions containing molybdenum such as those disclosed in U.S. Pat. No. 4,832,857, molybdenum complexes prepared by reacting a fatty oil, a diethanolamine and a molybdenum source as described in U.S. Pat No. 4,889,647, molybdenum containing compounds prepared from fatty acids and 2-(2-aminoethyl)aminoethanol as described in U.S. Pat No. 5,137,647, overbased molybdenum complexes prepared from amines, diamines, alkoxylated amines, glycols and polyols as described in U.S. Pat No. 5,143,633, and 2,4-heteroatom substituted-molybdena-3,3-dioxacycloalkanes as described in U.S. Pat No. 5,412,130.

Molybdenum salts such as the carboxylates are a preferred group of molybdenum compounds. The molybdenum salts used in this invention may be completely dehydrated (complete removal of water during preparation), or partially dehydrated. They may be salts of the same anion or mixed salts, meaning that they are formed from more than one type of acid. Illustrative of suitable anions there can be mentioned chloride, carboxylate, nitrate, sulfonate, or any other anion.

The molybdenum carboxylate is preferably that of a monocarboxylic acid such as those having from about 4 to 30 carbon atoms. Such acids can be hydrocarbon aliphatic, alicyclic or aromatic carboxylic acids. Monocarboxylic aliphatic acids having about 4 to 18 carbon atoms are preferred, particularly those having an alkyl group of about 6 to 18 carbon atoms. The alicyclic acids may generally contain from 4 to 12 carbon atoms. The aromatic acids generally contain one or two fused rings and contain from 7 to 14 carbon atoms wherein the carboxyl group may or may not be attached directly to the ring. The carboxylic acid can be a saturated or unsaturated fatty acid having from about 4 to 18 carbon atoms. Examples of carboxylic acids that may be used to prepare the molybdenum carboxylates include butyric acid, valeric acid, caproic acid, heptanoic acid, cyclohexanecarboxylic acid, cyclodecanoic acid, naphthenic acid, phenyl acetic acid, 2-methylhexanoic acid, 2-ethylhexanoic acid, suberic acid, octanoic acid, nonanoic acid, decanoic acid, undecanoic acid, lauric acid, tridecanoic acid, myristic acid, pentadecanoic acid, palmitic acid, linolenic acid, heptadecanoic acid, stearic acid, oleic acid, nonadecanoic acid, eicosanoic acid, heneicosanoic acid, docosanoic acid and erucic acid. The preferred molybdenum carboxylate is molybdenum octanoate.

Useful carboxylic acid amides include aliphatic monocarboxylic acid amides. These may be represented by the formula $(R^3CO)N(^4)(R^5)$ in which $R^3$ represents an alkyl or alkenyl group having 8 to 24 carbon atoms and $R^4$ and $R^5$ which may be the same or different are each independently hydrogen or alkyl of up to 7 carbon atoms. Typically, $R^3$ represents a $C_{14-18}$ alkyl radical. Amides of this type are described in U.S. Pat. No. 4,280,916. A preferred friction modifier falling within this class is oleyamide.

Friction modifiers which are useful in the present invention are commercially available or may be prepared by the adaptation or application of known methods.

The amount of the at least one friction modifier which is used is at least sufficient for it to exert its intended function of reducing micropitting. The friction modifier(s) is/are generally used at conventional treat rates. Typically, the total concentration of friction modifier used is 0.125 to 1% by weight based on the total weight of the lubricant composition. Preferably, the total amount of friction modifier is 0.15 to 0.75% by weight, more preferably about 0.5% by weight.

Mixtures of friction modifiers may be used. In this case friction modifiers of the same or different type may be used in combination. For example, satisfactory results have been obtained using combinations of dimethyloctadecyl phosphonate and a 3-$C_{18-24}$ alkenyl-2,5-pyrrolidindione. When mixtures of friction modifiers are employed the total amount of friction modifier is as described above.

It is important that the at least one friction modifier employed is sufficiently soluble in the lubricant composition at the treat rate at which it is used. It is also important that the at least one friction modifier is sufficiently compatible with the additional components commonly found in lubricating compositions. Such components include dispersants, detergents, antioxidants, extreme pressure agents, antiwear agents, foam inhibitors, viscosity index improvers and pour point depressants. These additives are themselves used in conventional amounts.

The base oil which is used to formulate lubricant compositions useful in the present invention may be natural or synthetic, or a blend thereof. Useful base oils are known in the art. The lubricant compositions are formulated in known manner by blending the individual components. The at least one friction modifier responsible for improving the micropitting performance may be added at the time the lubricant is formulated. Alternatively, the at least one friction modifier may be added as a top treat to improve or boost the micropitting performance of an existing formulated lubricant composition.

The invention also provides lubricant compositions which exhibit excellent micropitting performance relative to conventional lubricants. In one embodiment the invention provides a lubricant composition comprising an O,O-di-(primary alkyl)acyclic hydrocarbyl phosphonate as described above and a succinimide as described above. Preferably, the composition comprises dimethyloctadecyl phosphonate and a 3-$C_{18-24}$ alkenyl-2-pyrrolidindione. In another embodiment the composition comprises a molybdenum carboxylate, such as molybdenum octanoate, and a sulfurized isobutylene extreme pressure agent. The compositions may also include one or more of the other additive components described above.

The invention is illustrated in the following examples.

EXAMPLES 1–7

Lubricant compositions were prepared by blending the components listed in Table 1 below. The sulphur- and phosphorus-containing gear additive package had the following composition:

| | |
|---|---|
| 50 wt % | sulfurized isobutylene (extreme pressure agent) |
| 8 wt % | mixed phosphite and phosphate anti-wear agent |
| 17.5 wt % | phosphorylated, boronated succinimide dispersant |
| 9 wt % | rust inhibitor package |
| 2.6 wt % | corrosion inhibitor |
| 0.5 wt % | defoamer |
| 0.15% | demulsifier |
| 1.5 wt % | 3-$C_{18-24}$ alkenyl-2,5-pyrrolidindione |
| balance | base (diluent) oil |

The base oil was ESSO ISO 220. The viscosity grade of each composition was ISO 220.

TABLE 1

| | RUN | | | | | | |
|---|---|---|---|---|---|---|---|
| COMPONENT | 1 | 2 | 3 | 4 | 5 | 6 | 7 |
| Molybdenum octanoate | — | — | — | 0.50% | | | |
| Dimethyloctadecyl phosphonate | — | — | — | — | 0.50% | 0.25% | 0.50% |
| Dioleylphosphite | — | — | — | — | — | — | — |
| 3-$C_{18-24}$ alkenyl 2,5-pyrollidindione | — | — | 0.25% | — | — | 0.25% | 0.50% |
| Oleyamide | — | — | 0.20% | — | — | — | — |
| SIP Containing gear pack | 2.5% | 2.0% | 2.0% | 2.0% | 2.0% | 2.0% | 2.0% |

The coefficient of friction for each composition was measured at 130° C. using an HFRR operated under the conditions described in SAE Technical Paper 961142 (ball diameter 6 mm, load 4N, frequency 20 Hz, stroke length 1 mm; ball and flat ANSI 52100 steel). The HFRR coefficient of friction for each composition is given in Table 2. Each composition was also subjected to the FZG micropitting test in accordance with CEC L-07-A-71. The results obtained in this test are also shown in Table 2.

The solubility/compatibility of the friction modifier(s) within the lubricant compositions tested the appearance of the compositions was assessed visually. The presence of precipitate indicates poor solubility/compatibility. Table 2 reports the extent of the solubility/compatibility.

The percentage micropitting and weight loss were assessed after load stage 10. The weight loss was determined by comparing the initial weight of the gears under test with the weight of the gears after load stage 10. The results are also shown in Table 2.

TABLE 2

| RUN | 1 | 2 | 3 | 4 | 5 | 6 | 7 |
|---|---|---|---|---|---|---|---|
| HFRR | 0.110 | 0.109 | 0.102 | 0.087 | 0.094 | 0.098 | 0.091 |
| FZG | 10 FAIL | 9 FAIL | ABORTED | 10 PASS | 10 PASS | 10 PASS | 10 PASS |
| SOLUBILITY/ COMPATIBILITY | GOOD | GOOD | BAD | SATISFACTORY | SATISFACTORY | SATISFACTORY | SATISFACTORY |
| % MICROPITTING* | — | 18.0 | — | 12.0 | 8.62 | 8.43 | 9.40 |
| WEIGHT LOSS* (mg) | — | 22 | — | 9 | 10 | 11 | 15.0 |

*After load stage 10.

In this table the FZG result is given as a load stage result (in the stepwise phase). A profile deviation of 7.5 μm is used to differentiate a pass or fail result at any given load stage. For example, Runs 1 and 2 give "10 fail" and "9 fail" results respectively which means that the profile deviation exceeded 7.5 μm after load stage 10 (Run 1) and load stage 9 (Run 2). Runs 4–7 on the other hand give an FZG result of "10 pass" which means that the profile deviation has not exceeded 7.5 μm after load stage 10.

The results in Table 2 show that the friction coefficient obtained in the HFRR test may be used to predict which friction modifier(s) is/are useful in improving micropitting performance. HFRR results of less than 0.100 are predictive of friction modifiers which give improved micropitting performance.

The lubricant composition used in Runs 1 and 2 is a conventional gear lubricant. This gives reasonable micropitting protection, the 7.5 μm threshold being exceeded after load stage 10 (Run 1) or 9 (Run 2). For Run 3 the micropitting test was aborted after load stage 6 because the composition tested was found to contain precipitate. This emphasises the need for the friction modifiers used to be fully soluble/compatible in lubricant at the treat rate at which they are used. The compositions used in Runs 4–7 illustrate the present invention and give improved FZG results of "10 pass" when compared with the conventional lubricant compositions of Runs 1 and 2. A consistent "10 pass" result would be very acceptable in the industry. Runs 4–7 also showed acceptably low levels of percentage micropitting and weight loss.

EXAMPLE 8

To confirm the accuracy of the friction modifier screening procedure glycerol monooleate, a friction modifier which is known to exhibit poor micropitting protection, was included in a lubricant composition having a viscosity grade ISO 220 and the resulting composition tested using the HFRR test (in accordance with SAE Technical Paper 961142). The composition gave an HFRR result of 0.114, i.e. well above the threshold value of 0.100.

EXAMPLES 9 AND 10

The HFRR screening procedure was repeated using compositions using a different sulphur- and phosphorus-containing gear additive package. The base oil was ESSO ISO 220. The viscosity grade of the formulated compositions was ISO 220. The treat rate of the various components and the HFRR results obtained are shown in Table 3 below.

TABLE 3

| | RUN | |
|---|---|---|
| COMPONENT | 9 | 10 |
| Dimethyloctadecyl phosphonate | — | 0.25% |
| 3-$C_{18-24}$ alkenyl 2,5-pyrollidindione | — | 0.25% |
| S/P Containing gear pack | 2.0% | 2.0% |
| HFRR | 0.105 | 0.070 |

The HFRR result for Run 9 of in excess of 0.100 is consistent with the HFRR results for Runs 1 and 2 in Table 1. The composition used in Run 10 included a combination of friction modifiers which are known to give improved micropitting performance (see the result for Run 6 in Table 2). The HFRR result for Run 10 is less than 0.100. This is consistent with the HFRR result obtained for Run 6 in Table 2 where a different gear additive package was used in formulating the composition under test. This shows that the HFRR screening procedure remains predictive of useful friction modifiers even when different gear additive packages are used in formulating the lubricant compositions.

What is claimed is:

1. A method for lubricating gears comprising contacting said gears with a lubricant composition comprising a molybdenum carboxylate and a sulfurized isobutylene extreme pressure agent.

* * * * *